United States Patent [19]

Eckert

[11] 4,129,953

[45] Dec. 19, 1978

[54] POSTER FRAME AND MOLDING METHOD

[75] Inventor: Ronald P. Eckert, Northbrook, Ill.

[73] Assignee: DLM Inc., Niles, Ill.

[21] Appl. No.: 837,740

[22] Filed: Sep. 29, 1977

[51] Int. Cl.[2] ..... G09F 1/12

[52] U.S. Cl. ..... 40/156

[58] Field of Search ..... 40/152, 156, 152.1, 40/10R

[56] References Cited

U.S. PATENT DOCUMENTS

| | | | |
|---|---|---|---|
| 1,463,150 | 7/1923 | Carlsen | 40/152 |
| 2,752,712 | 7/1956 | Hase et al. | 40/152 |
| 2,823,478 | 2/1958 | Ostergaard | 40/152 |
| 3,039,217 | 6/1962 | Stefanakis | 40/152 |
| 3,771,244 | 11/1973 | Ebner | 40/152 |

*Primary Examiner*—Louis G. Mancene
*Assistant Examiner*—Wenceslao J. Contreras
*Attorney, Agent, or Firm*—Emrich, Root, O'Keefe & Lee

[57] ABSTRACT

A unitary molded frame structure having a recessed back edge to receive a poster board or picture and a pair of duplicate slotted clamping members which slideably engage at least a pair of hook-like protrusions on the frame back and snap-engage over the edges of the poster board to hold it firmly within the frame. The clamping members provide multiple attaching means for hanging the frame at the desired attitude from a wall surface. Once assembled, the clamping means are recessed within the back of the frame against the back of the poster or a cardboard back-up sheet in a hidden position and the weight of the assembly in at least one hanging attitude biases the cooperating slot-protuberance combination into tighter engagement. The frame and clamping members are molded in a common mold with the clamping members co-planar within the inner opening of the frame and oriented and spaced in such a manner that they are readily broken out and are ready for assembly with the frame to hold a picture.

7 Claims, 8 Drawing Figures

POSTER FRAME AND MOLDING METHOD

BACKGROUND OF THE INVENTION

The prior art shows a number of wooden and molded plastic frame structures having interlocking back panels for holding an object to be displayed within the frame, such as pictures, signs, mirrors and the like. Esry U.S. Pat. No. 3,782,015 is directed to a display frame having an outer shell with a transparent face and peripheral vertical sides forming an opening for a display card. A core of corresponding configuration is provided which fits within the sides of the outer shell. A pair of inwardly directed tabs is provided on opposite edges of two of the sides that releasably engage over the back surface of the core. Place, in his U.S. Pat. No. 1,842,285, uses wire pins having bent arcuately contoured heads that engage within slots or holes in the back flanged edge of a molded picture frame to hold the backing sheet thereagainst.

Another illustration is Novak U.S. Pat. No. 2,928,199 which discloses a metal mounting structure for mirrors having a front frame with four L-shaped corner clips that are locked in place by a hook and socket arrangement on the back plate. U.S. Pat. No. 2,116,584 to Shelby shows a ribbed T-lock joint and recess combination for holding sections of wooden pieces together without the necessity of clamping during the drying of glue used in the joints. The Ware U.S. Pat. No. 1,837,348 incorporates a pair of headed studs on the edge of a pedestal that releasably engage a matching pair of key-hole slots in the edge of a frame for holding a display card on or from a horizontal surface. The display frame of Siegel in U.S. Pat. No. 1,692,999 utilizes an interior and exterior frame which fit in a locking arrangement by means of spring-loaded detents or plungers on the periphery of the interior frame which engage recesses in an inner edge of the exterior frame.

The instant invention represents an improvement over these prior art structures as hereinafter described.

SUMMARY OF THE INVENTION

In accordance with the present invention, a unitary molded picture frame and duplicate clamping members are provided which facilitate the mounting of the picture therein. The clamping members are molded within the plane and frame of reference of the frame member proper. The clamping members are of such a size that they encompass a substantial portion of the periphery of the picture cardboard and its backing so that practically the entire peripheral edge of the picture is in clamped relationship with the frame. The mold is divided in four sections, both transverse the longitudinal axis of the frame and also within the plane of the retaining edge for the picture cardboard and the plane of the backside of the clamping members. Because of the essentially rectangular configuration of both the frame and the clamping members within the inside opening thereof, it is possible to orient the two clamping members in such a manner that they are reversed from their positions when in use and fit within the retaining edges of the back opening of the frame in the desired manner. In addition, the raised portion of the backside of the clamping members lie in the plane of the front edge of the frame proper which greatly simplifies the preparation of the mold. This arrangement also allows the proper placement of the spew openings for the plastic to flow into the various corners and configurations of the mold in an even manner.

Relating to the structure of the frame and clamping member combination of this invention, a number of features have been incorporated which represent marked improvements over the prior art devices. One primary consideration is that the manner in which the clamping members engage the frame, for, they not only clamp the picture cardboard pieces into the back opening of the frame, but the hanging configuration of the frame tends to increase this clamping action. These and other improvements in picture frame construction will be described or become apparent as the description of the invention proceeds.

DESCRIPTION OF THE DRAWINGS

A specific embodiment of the invention is illustrated in the drawings wherein.

DESCRIPTION OF THE PREFERRED EMBODIMENTS

Figure 1:
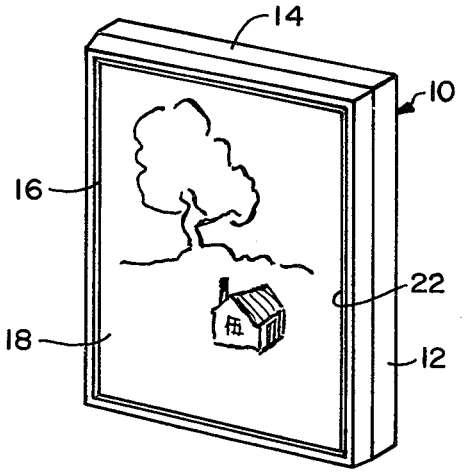
FIG. 1 is a perspective view of the picture frame of this invention showing the front side with a picture exposed therein.

Referring to FIG. 1 the frame member 10 includes, in the orientation shown, a side wall 12 and top wall 14 molded in a unitary rectangle and having the inner flange 16 which defines an opening and retaining edge for the picture 18. The exposed surfaces of the walls 12 and 14 can include suitable decorative embossments provided by the mold surface configuration. The picture 18 is printed on a relatively thin paper sheet (see FIG. 3) which is flexible and may require a backing 20 of cardboard so that it will be stiffened and lie or be retained in a flat and un-wrinkled condition in the frame 10.

The sides 12 and 14 are of the same cross-sectional configuration to include the outer facing edge 22. As further indicated in FIG. 8, the side walls 12 and 14 can have beveled surfaces and the outer or facing edge 22 can carry a trim embossment raised for hot stamping for contrasting or accent colors.

The side walls 12 and end walls 14 can be of the same length and the frame body is generally U-shaped in cross-section, defining a first inner edge 24 and a second inner edge 26 which are not coplanar, the wall 16 being fore-shortened so that there is provided an encompassing recess to receive the picture 18 and the cardboard backing 20.

Projecting inwardly from the edge 22 is the intermediate wall 30 that is spaced from the outer walls 12 and 14 as well as the inner flange wall 16. The innermost edge 32 of the intermediate wall 30 extends above (or further inwardly from the wall 22) the edge 26 of the inner flange 16.

Figure 8:
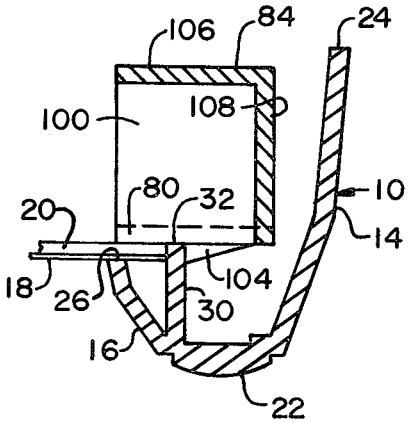
FIG. 8 is a cross-sectional view taken along lines 8—8 of FIG. 5.

Both the flange 16 and the intermediate wall 30 extend in the relationship shown in FIG. 8 around the inside of the frame 10. The difference between the heights or widths of these inner walls 16 and 30 defines an off-set to receive the edges of the picture 18 and the back-up cardboard 20.

Figure 2:
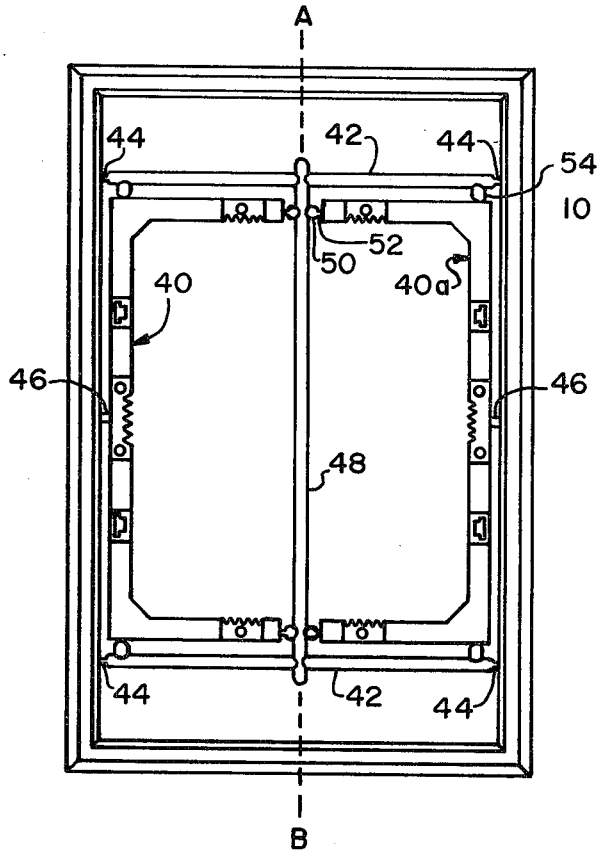
FIG. 2 is a top plan view of the combination of the integral molded frame and its clamping members as they are removed from the mold.

A pair of identical clamp members 40 and 40*a* is provided for attachment against the contiguous backing 20 and picture 18, same being molded integral with the frame 10 as shown in FIG. 2 wherein these parts are shown as the molded plastic frame is removed from the mold.

In FIG. 2 the pair of U-shaped clamps 40 is shown with the inter-connected runners 42 across their ends and connected by means of the gates 44 to the main body of the frame 10 at their ends. A pair of intermediate smaller gates 46 is positioned mid-way of each clamp. The pair of runners is connected longitudinally by the runner 48 having the smaller cross-runners 50, each connected by a gate 52 to the ends of the clamps 40. The mold proper would be in four parts, divided longitudinally along the line A-B and horizontally in the plane of the bottom surfaces of the clamps 40. Additional small runners and gates are provided at 54 near the corners of the clamps.

The design of the frame 10 and its clamps 40 is such that the general principles for designing with plastics are followed to eliminate welds and flow lines as well as undesired surface imperfections and to prevent warpage of the longer flat parts of the clamps. The molded parts of FIG. 2 are compact and essentially coplanar so that they can be packaged and shipped in the form shown and the clamps can be readily broken out for use.

Figure 3:
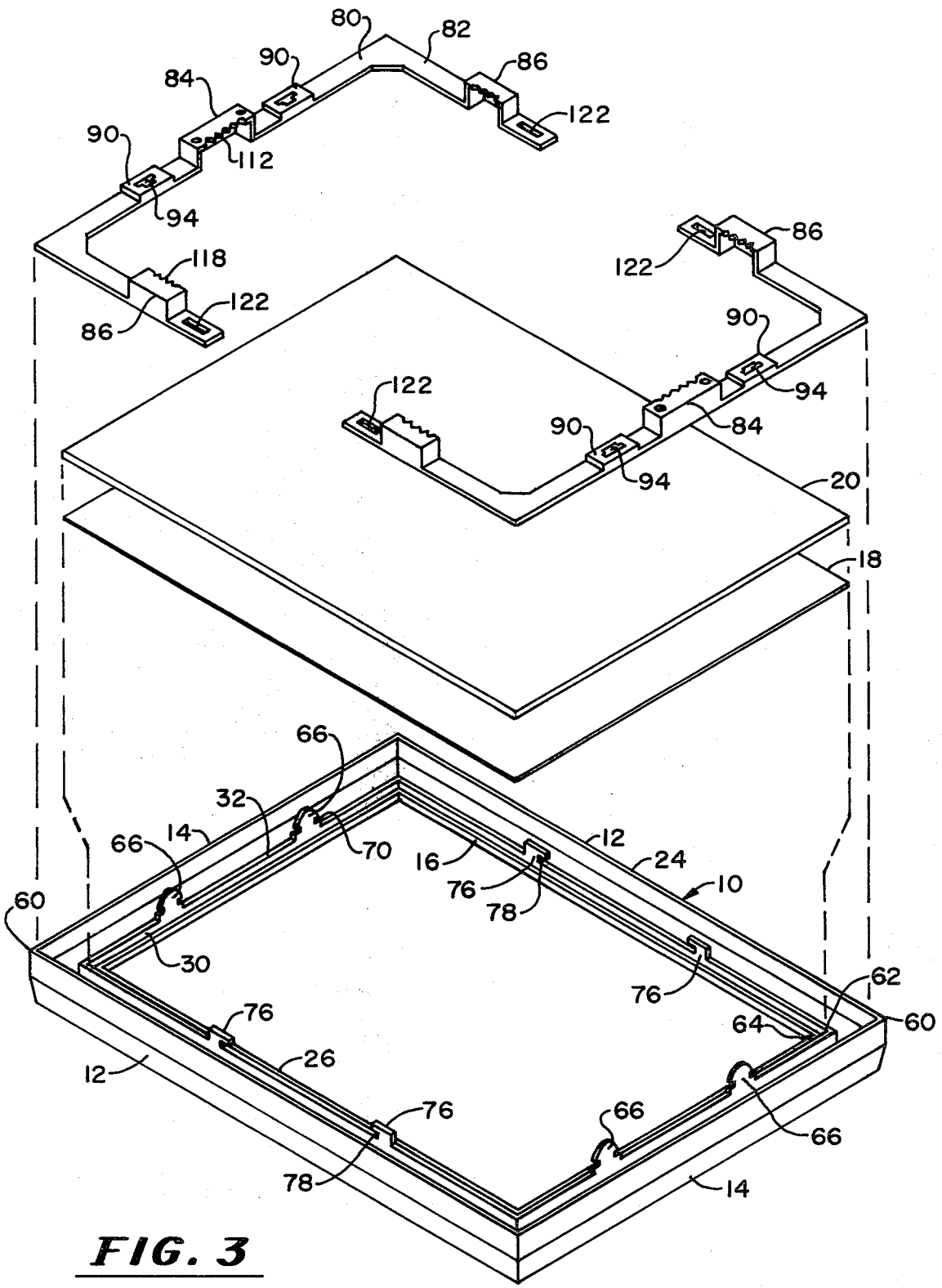
FIG. 3 is an exploded view of the backside of the frame showing the assembly of the picture, the back-up cardboard and the pair of clamping members.
Figure 4:
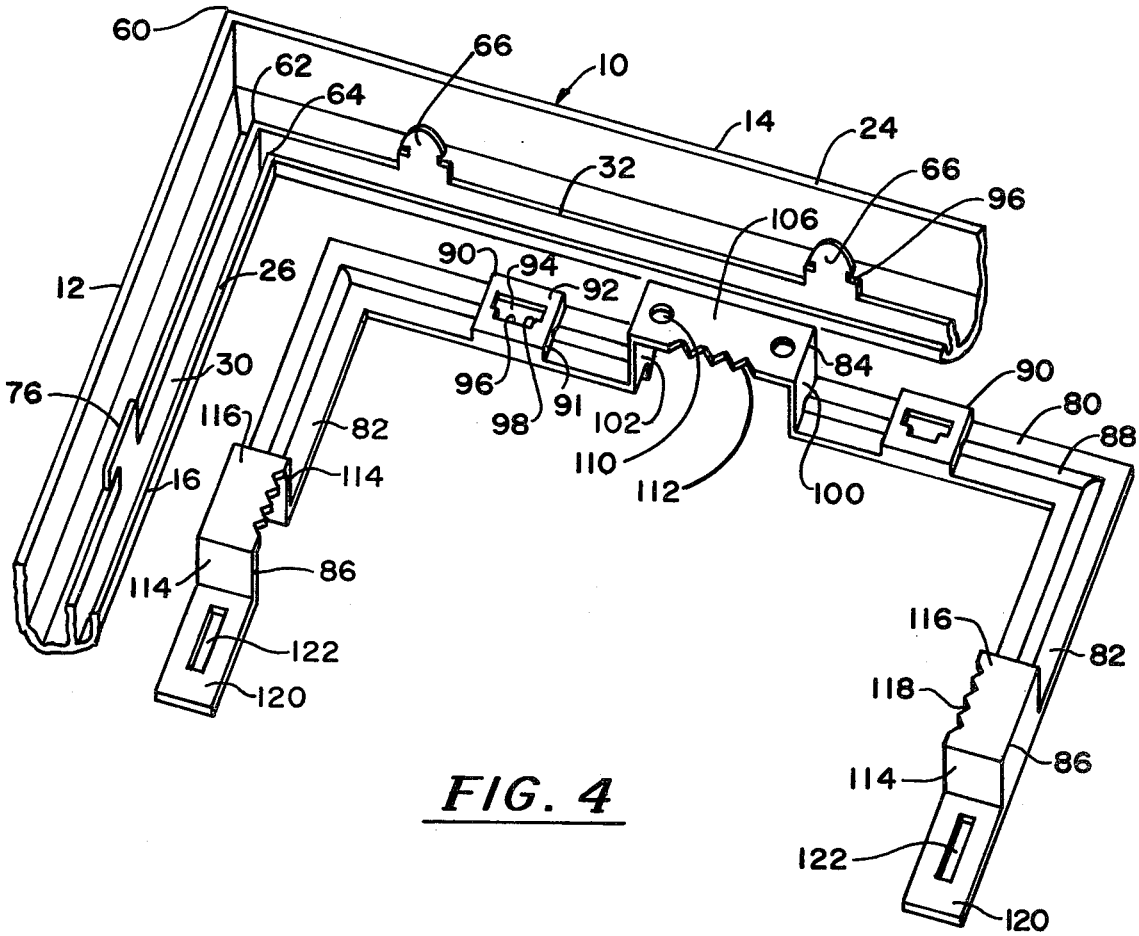
FIG. 4 is a fragmentary perspective view of the backside of the frame showing one corner thereof in conjunction with one of the clamping members to illustrate the relationship between the clamping portions thereof.

Referring to FIGS. 3 and 4 it is seen that the end or top wall 14 of the frame 10 joins the side or bottom wall 12 at the corner 60 and also the inner part of the frame has the upstanding inner walls 16 and 30 extending in uniform, spaced parallel relationship around the inside of the frame and joined at their respective corners 62 and 64. If desired, the corners 60, 62 and 64 can be rounded instead of angular.

The intermediate wall 30 is deeper than the wall 16 and includes the pair of tabs 66 on the edge 32 having arcuate top portions 68 and a pair of oppositely opening notches 70 with a larger base 72. The tabs 66 extend vertically from the edge 32 of the wall 30 at each end 14 of the frame and are of the same thickness as the wall 30.

Figure 5:
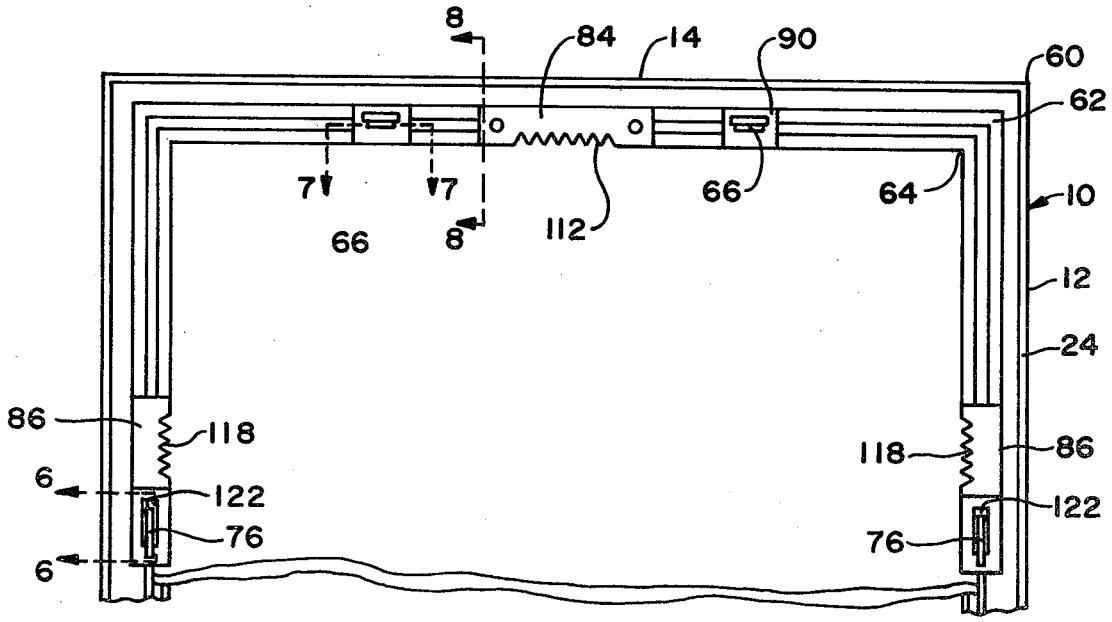
FIG. 5 is a fragmentary plan view of the backside of the frame showing a clamping member in place holding a backing cardboard and picture within the frame.

The sides 12 each have the upstanding pair of hooks 76 (see also FIGS. 5 and 6) which are an extension of the inner wider wall 30 and its top edge 32 and are equally spaced longitudinally from the corner 64. The hooks 76 have the notches 78 that open toward the center of the frame, that is, away from the ends 14. Thus, each pair of hooks on the sides 12 have their notches 78 opening toward each other. The tabs 66 are of identical dimension and the hooks 76 are similarly sized. Each of these attaching means 66 and 76 is the same thickness as the wall 30 and the notches 70 and 78 define openings that slideably engage the clamping means 40 in a manner to be described.

As before mentioned, the clamping means 40 are readily broken out of the integral molded assembly shown in FIG. 2. Each of the clamping means 40 has a generally flat cross body 80 with the equal-length flat legs 82 on each side defining a U-shape, having a width sufficient to span the inside of the shorter dimension of the frame 10. The legs 82 are long enough to span about one-third of the length of the longer side of the frame 10. Substantially central of the body 80 there is provided the box-shaped hanger 84 while each leg has a similar box-shaped hanger 86.

Both the body 80 and the legs 82 are flat and include the reinforcing rib 88 on the back side that extends over a substantial part of each clamp member. The body has the pair of raised, box-like open-bottomed housings 90 having upstanding end walls 91 and covered by the flat top 92 having the T-shaped slot 94 therein. The slot 94 has its narrow open leg 96 on the inner side and the corners 98 are rounded. The housings 90 are identical in construction and spaced on each side of the hangers 84.

The T-slots 94 extend longitudinally of the body 80 and to the outside of the plane of the rib 88. The T-slots 94 are slightly wider than the tongues or tips 68 of the tabs 66 while the narrow open legs or bases 96 of the slots are slightly wider than the distance between the two notches 70 on each tab 66. The housings 90 are spaced along the body 80 the same distance as the tabs 66 are spaced along the inner wall 30 of the frame 10.

The central box-shaped hanger 84 has spaced end walls 100 and 102, each having a downwardly or inwardly projecting ear 104 that extends below the planar, inner surface of the body 80 of the clamps. The purpose therefor will be described. The top wall 106 joins the back wall 108 which extends from the outer edge of the body 80. A pair of spaced holes 110 are included in the top wall 106 for attachment of picture wire as desired. A series of notches 112 are provided in the inside edge of the top wall 106. An odd number of such notches is provided in order that there be a central notch for engagement with a nail or other projecting hanger affixed to the wall to facilitate hanging the frame in a level position therefrom.

The pair of hangers 86 are similar to the central hanger 84 except that the ears 104 are omitted. These hangers have end walls 114 and a top wall 116 and extend about the same height as the central hanger 84 from the respective legs 82. The hangers 84 also have a series of notches 118 in their top walls 116 for this same purpose.

Each hanger 86 is spaced from the flat ends 120 of the legs 82 and an elongated slot 122 is provided in these respective ends.

Figure 6:
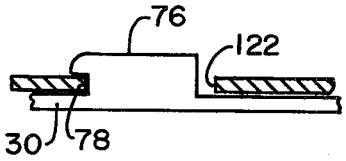
FIG. 6 is a cross-sectional view taken along lines 6—6 of FIG. 5.
Figure 7:
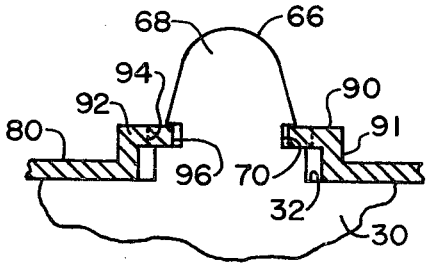
FIG. 7 is a fragmentary, cross-sectional view taken along lines 707 of FIG. 5.

There being two spaced tabs 66 on each end of the frame 10 and two spaced tabs 76 on each side, it is now apparent that, with a picture 18 in place with its outer edge on the edge 26 of the inner wall 16 and a backing cardboard 20 thereover, each of the U-shaped clamps 40 can be placed thereover with the tabs 66 within the slots 94 and the tabs 76 within the slots 122 and the ears 104 upon the edge 32 of the intermediate wall 30. In this position, it is merely necessary to move each clamp 40 and 40*a* toward the respective wall 14 so that the notches 70 cam over the round corners 98 of the notches and engage across the base openings 96. At the same time the notches 78 engage over the outermost ends of the slots 122 as shown in FIG. 6. This brings the corners or ears 104 into a position where they snap behind the edge 32 of the wall 30 as shown in FIG. 8.

If the picture frame is to be hung from an end 14 on the clamp 40 in FIG. 4, it is seen that the weight of the picture holds the clamp 40 in this snap-fit relationship. If the picture frame is to be hung from the pair of space box hangers 86 along the side 12 of the frame 10, the weight of the frame and picture does not disturb this relationship.

From the description of this invention it is apparent that a number of modifications can be made in the picture frame. Only one clamp member 40 can be used if desired. In order to take advantage of the single mold method of fabrication, one dimension of the frame must be longer than the other in order to accommodate the length of the body portion of the clamping members along that longer side and leave room for the runners 42. However, the legs 82 of clamping members 40 can be of different lengths as long as the sum of the lengths of the legs across the side of the frame, which is shorter, is less than this shorter dimension. This would mean that the runner 48 could extend at an angle between the runners 42 and thus shorten one leg 82 by the amount the other is lengthened.

The use of box-like hangers 84 and 90 places the point of attachment of the frame closer to the wall surface and assures that the picture will hang essentially parallel to the wall surface. The frame 10 can also be oval instead of rectangular as long as the tabs 66 are set at a slight off-set so that they engage the slots 94 in the manner described.

Any type of moldable thermoplastic resin can be used to fabricate the frame and clamp members in accordance with this invention, a preferred plastic being high impact polystyrene or the equivalent.

What is claimed is:

1. A picture frame comprising:

a unitary frame having end and side portions of U-shaped cross-section defined by an outer trim wall, a peripheral wall and an inner wall;

said outer wall having a width greater than said inner wall;

an intermediate wall extending between and in spaced relationship with said peripheral and inner walls;

said intermediate wall having a width greater than said inner wall to provide a rimmed recess to receive the edge of said picture;

an end and a side of said frame each having a pair of tab members extending in the plane of and from said intermediate wall;

said tab members on said end of said frame having opposed notches on the sides thereof;

said tab members in said side of said frame having notches on a side away from said end of said frame; and at least one U-shaped clamp member adapted to hold said edge of said picture within said rimmed recess;

said clamp member having a body portion and a pair of leg members having slots registrable with said tab members and engageable into said notches whereby to snap-fit against the edges of said picture.

2. A picture frame in accordance with claim 1 in which:

a pair of said U-shaped clamp members is provided, each encompassing an end of said frame and the legs of which extend along a portion of both sides thereof.

3. A picture frame in accordance with claim 1 in which:

said tab members on said end of said frame have arcuate top ends;

said slots in said body portion of said clamp member are T-shaped to receive said tab members and the base openings thereof engage across said opposed notches of said tab members; and the ends of said slots in the legs of said clamp member engage under the notches in said tab members on the tabs carried by the sides of said frame.

4. A picture frame in accordance with claim 1 in which:

said clamp member has a planar inner face along its body and leg portions and includes at least one depending ear on said planar that is engageable over and against the inside corner of the top edge of said intermediate wall.

5. A picture frame in accordance with claim 2 in which:

the body portions of said clamp members are coextensive with one dimension of said frame member; and the leg portions thereof are less than half the length of the other dimension of said frame member.

6. A picture frame comprising:

a unitary frame having ends and sides of U-shaped cross-section defining an outer trim wall and a rimmed inner recess to receive the edges of said picture;

upstanding tab members bordering said rimmed recess at said ends and sides;

each of said tab members having a notches edge;

a pair of essentially flat U-shaped clamp members adapted to hold the edge of said picture against said rimmed recess;

said clamp members being arranged with their leg portions in opposing positions within said frame; and said clamp members having slots registrable with said tab members in a snap-fit relationship wherein the slots of said clamp members slideably engage said tab members into a locked, overlapped position with said notched edges.

7. A picture frame in accordance with claim 6 in which:

said frame member includes an inner flanged wall that borders the edge of said picture in the clamped position; and a cleat member is provided on each of said clamp members that engages in a snap-fit relationship over the top edge of said flanged wall, said cleat member having a depth greater than the thickness of said picture to allow for variations in said thickness and the inclusion of a back stiffening sheet for said picture.

* * * * *